US012758044B1

(12) United States Patent
Liu

(10) Patent No.: US 12,758,044 B1
(45) Date of Patent: Oct. 13, 2026

(54) WALL-MOUNTED HAT RACK

(71) Applicant: Yun Liu, Shaoyang (CN)

(72) Inventor: Yun Liu, Shaoyang (CN)

( * ) Notice: Subject to any disclaimer, the term of this patent is extended or adjusted under 35 U.S.C. 154(b) by 0 days.

(21) Appl. No.: 19/404,565

(22) Filed: Dec. 1, 2025

(30) Foreign Application Priority Data

Nov. 14, 2025 (CN) ..... 202522430931.1

(51) Int. Cl.
*A47G 25/10* (2006.01)

(52) U.S. Cl.
CPC ..... *A47G 25/10* (2013.01)

(58) Field of Classification Search
CPC ..... A47G 25/10; A47F 7/06
See application file for complete search history.

(56) References Cited

U.S. PATENT DOCUMENTS 3,797,076 A * 3/1974 Watkin ..... B65D 67/02 24/562
4,673,153 A * 6/1987 Hilty ..... A47F 7/06 D6/326
5,188,325 A * 2/1993 Hilty ..... A47F 7/06 211/32
5,240,123 A * 8/1993 Hawk ..... A47F 5/0807 211/32
5,725,356 A * 3/1998 Carter ..... F16M 11/40 D23/382
6,223,910 B1 * 5/2001 Levin ..... A47F 7/06 211/113
D675,312 S * 1/2013 Zhu ..... D23/370
10,590,591 B2 * 3/2020 Bruneau ..... F16B 2/22
11,122,924 B2 9/2021 Williams, Jr.
11,350,772 B2 * 6/2022 Quezada ..... B60R 7/10
11,484,140 B2 11/2022 Giles
D1,005,704 S * 11/2023 Lai ..... D6/323
D1,062,259 S * 2/2025 Xu ..... D6/326
12,220,071 B1 * 2/2025 Jiang ..... A47F 5/0006
2020/0046153 A1 2/2020 Fotino et al.
2020/0146470 A1 * 5/2020 Quezada ..... B60R 7/10
2021/0321806 A1 10/2021 Giles
2022/0175998 A1 6/2022 Vargas
2023/0301451 A1 * 9/2023 Park ..... A47G 25/10

FOREIGN PATENT DOCUMENTS

CN 223323339 U 9/2025

* cited by examiner

*Primary Examiner* — Ko H Chan

(57) ABSTRACT

A wall-mounted hat rack for displaying or storing a baseball cap. The hat rack includes a hat rack main body, having a first surface extending along a preset direction; and at least one clamping assembly. Each clamping assembly includes a first clamping part and a second clamping part; where the first clamping part and the second clamping part are arranged along an extension direction of the first surface, enabling at least a portion of the baseball cap to be selectively insertable between the first clamping part and the second clamping part and clamped and fixed by a relative clamping force between the two clamping parts. Each clamping assembly further includes an engagement part, disposed on each of at least one of a first clamping surface of the first clamping part and a second clamping surface of the second clamping part, for limiting a cap button of the baseball cap.

13 Claims, 6 Drawing Sheets

WALL-MOUNTED HAT RACK

CROSS REFERENCE TO RELATED APPLICATIONS

The present application claims priority of Chinese Patent Application No. 202522430931.1, filed on Nov. 14, 2025, in the China National Intellectual Property Administration, the entire contents of which are hereby incorporated by reference in its entirety.

TECHNICAL FIELD

The present disclosure relates to a wall-mounted hat rack, and particularly to a device for displaying or storing baseball caps.

BACKGROUND

With the improvement of people's living standards and the growing demand for personalized accessories, baseball caps, as a popular accessory, are increasingly favored. However, effectively displaying and storing these caps has become a problem that needs to be solved. In the related art, traditional hat rack designs are usually relatively simple, mainly adopting the form of hooks or racks, which not only occupy a relatively large amount of space but are also lacking in display effect. Furthermore, existing hat racks often fail to adapt well to baseball caps of different shapes and sizes, leading to inconvenience of use.

SUMMARY OF THE DISCLOSURE

The primary objective of the present disclosure is to provide a wall-mounted hat rack that achieves effective fixation of baseball caps through the arrangement of a clamping assembly and an engagement part. This design not only improves space utilization but also ensures that the caps are displayed or stored safely and neatly.

To achieve the aforementioned objective, the present disclosure provides the following technical solution: A wall-mounted hat rack for displaying or storing a baseball cap, including:

- a hat rack main body, having a first surface extending along a preset direction; and
- at least one clamping assembly, each including a first clamping part and a second clamping part; wherein the first clamping part and the second clamping part are arranged along an extension direction of the first surface, enabling at least a portion of the baseball cap to be selectively insertable between the first clamping part and the second clamping part and clamped and fixed by a relative clamping force between the first clamping part and the second clamping part;
- wherein each clamping assembly further includes an engagement part, disposed on each of at least one of a first clamping surface of the first clamping part and a second clamping surface of the second clamping part, for limiting a cap button of the baseball cap.

In some embodiments, the engagement part includes at least one through hole; in a case where the first clamping part and the second clamping part clamp the baseball cap, the cap button of the baseball cap passes through a corresponding through hole, thereby fixing a clamped position of the baseball cap.

In some embodiments, the engagement part further includes a groove; the groove is disposed on the first clamping surface of the first clamping part, and the at least one through hole extends through a bottom of the groove.

In some embodiments, a first abutting part is disposed on a side of the first clamping part facing the second clamping part; a second abutting part is correspondingly disposed on a side of the second clamping part facing the first clamping part; each clamping assembly further includes an elastic member, both ends of the elastic member are connected to the first abutting part and the second abutting part respectively, to provide the relative clamping force.

In some embodiments, the first abutting part has a first slot; the second abutting part has a second slot, and the both ends of the elastic member extend into the first slot and the second slot respectively to achieve peripheral limitation of the both ends of the elastic member.

In some embodiments, each clamping assembly further includes a bending part; the first clamping part and the second clamping part are connected by the bending part to form an elastically deformable clamping structure.

In some embodiments, the first clamping part, the second clamping part, and the bending part are an integrally formed structure.

In some embodiments, the first clamping part has a first outer edge, and the second clamping part has a second outer edge; a length of the second outer edge extending outward is greater than a length of the first outer edge extending outward, to form an asymmetric clamping structure, facilitating engagement and positioning of the cap button.

In some embodiments, the at least one clamping assembly is a plurality of clamping assemblies that are arranged at intervals along the extension direction of the first surface.

BRIEF DESCRIPTION OF THE DRAWINGS

Drawings, which form a part of the present disclosure, are provided to facilitate further understanding of the present disclosure. The schematic embodiments and descriptions of the present disclosure are intended to explain the present disclosure and do not constitute an undue limitation of the present disclosure.

REFERENCE NUMERALS

Figure 1:
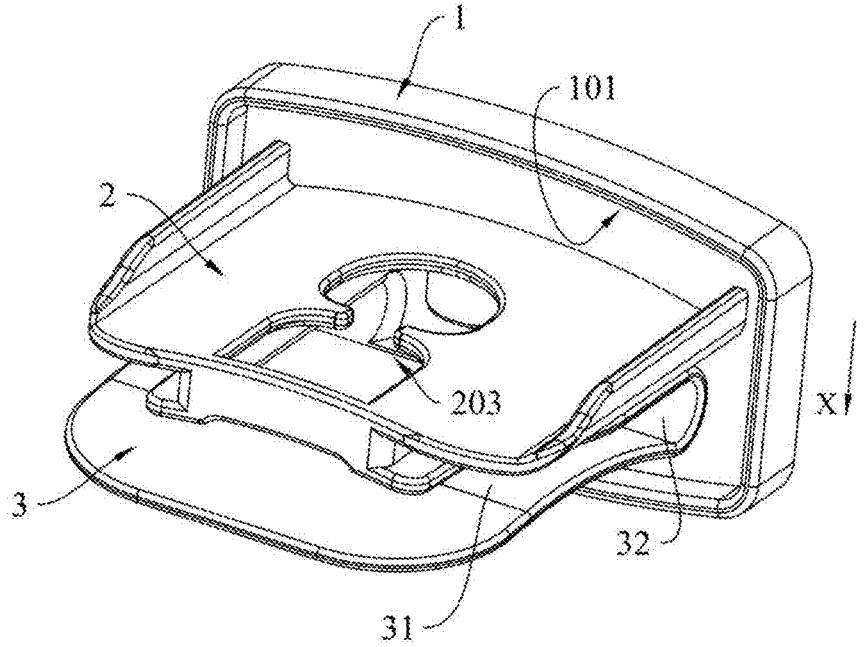
FIG. 1 is a perspective view of a wall-mounted hat clip in Embodiment 1 of the present disclosure.
Figure 2A:
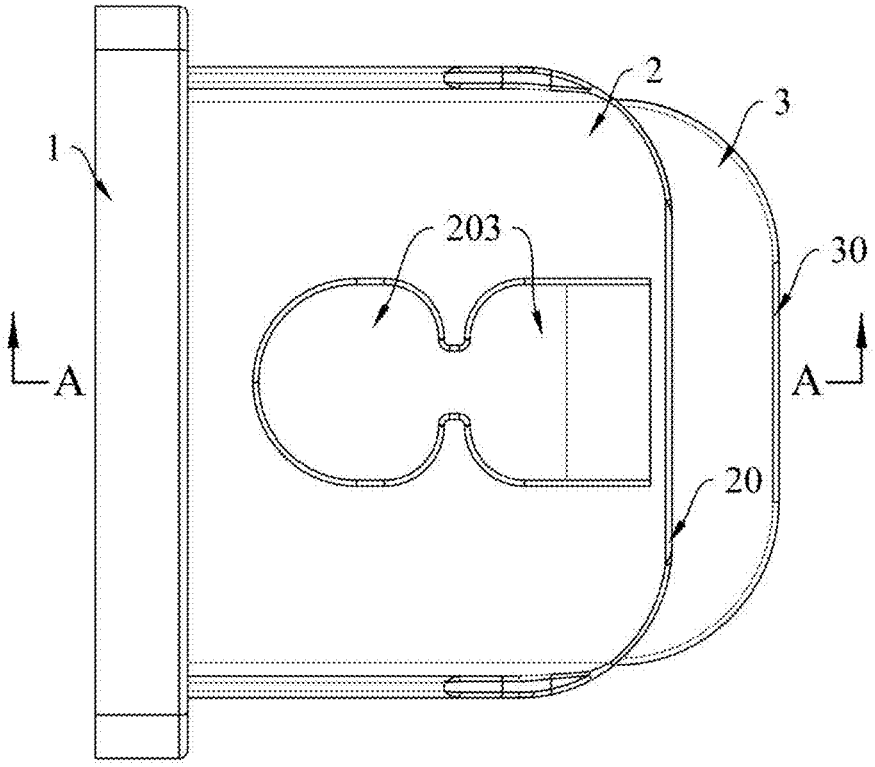
FIG. 2A is a top schematic view of the wall-mounted hat clip in Embodiment 1 of the present disclosure.
Figure 2B:
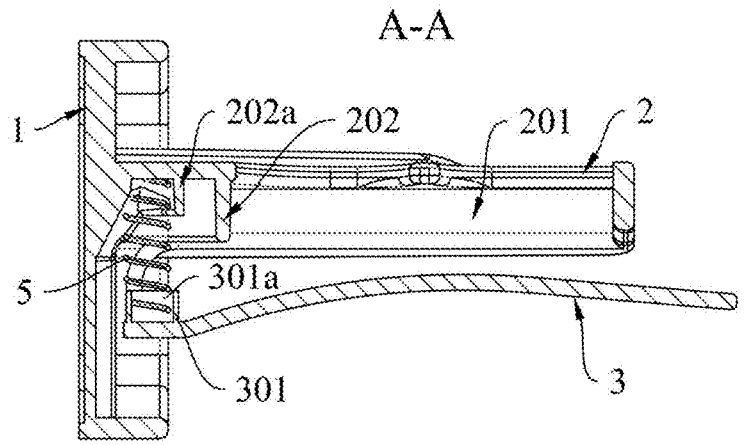
FIG. 2B is a perspective view taken along the A-A direction in FIG. 2A in Embodiment 1 of the present disclosure.
Figure 3:
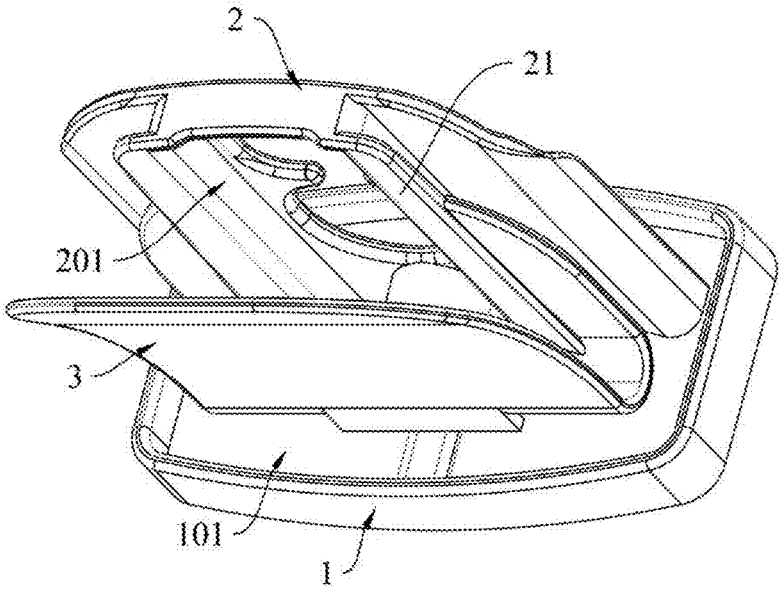
FIG. 3 is a perspective view of a clamping assembly of the wall-mounted hat clip, in an open state, in Embodiment 1 of the present disclosure.
Figure 4:
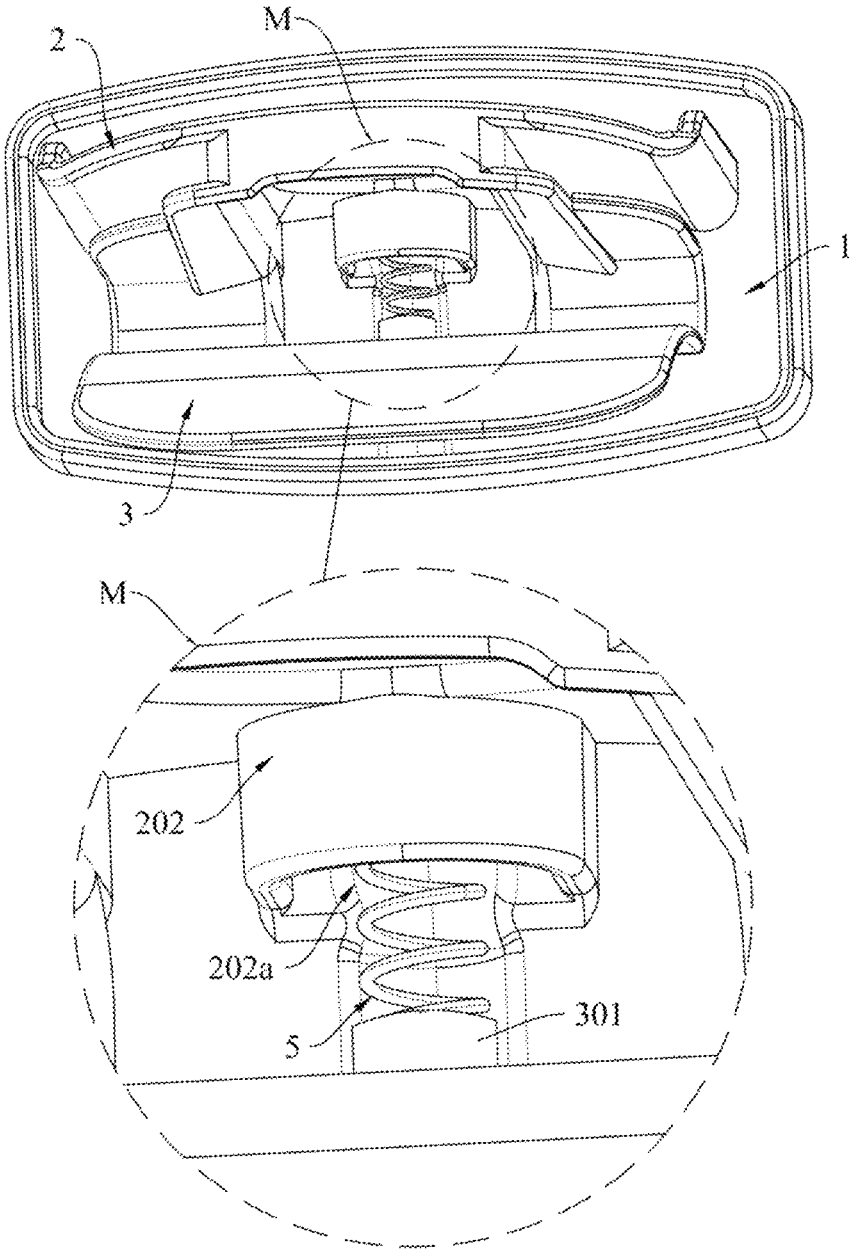
FIG. 4 is a perspective view of the clamping assembly of the wall-mounted hat clip, in an open state, from another angle and an enlarged view at position M in Embodiment 1 of the present disclosure.
Figure 5:
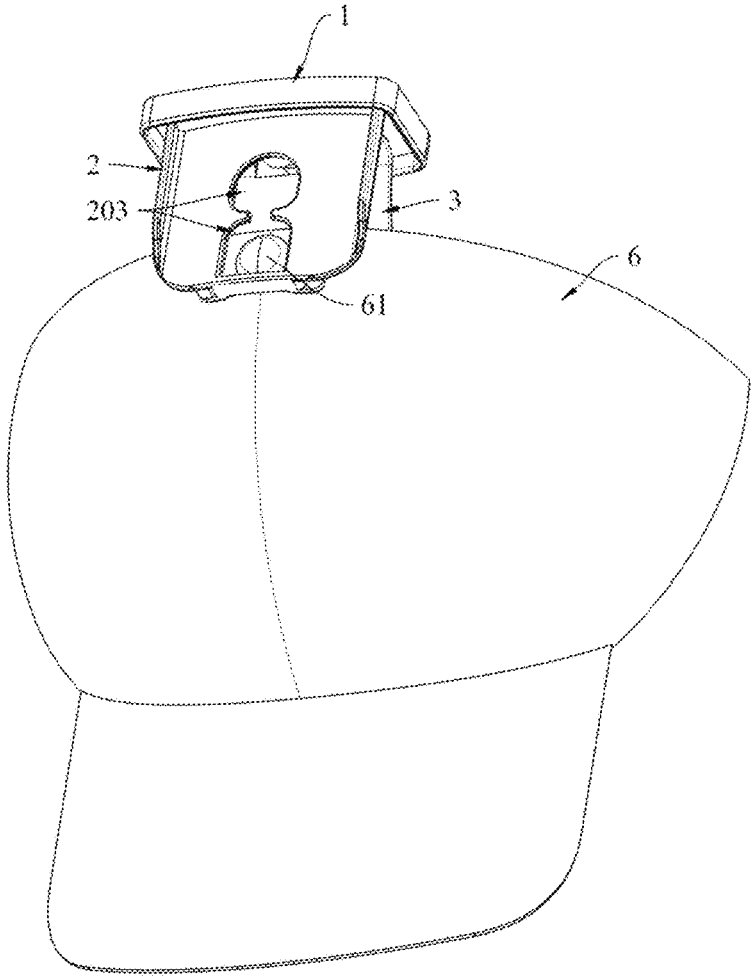
FIG. 5 is a perspective view of the wall-mounted hat clip clamping a baseball cap in Embodiment 1 of the present disclosure.

1—Hat rack main body; 101—First surface;
2—First clamping part; 20—First outer edge; 21—First clamping surface;
201—Groove; 202—First abutting part;
202*a*—First slot; 203—Through hole;
3—Second clamping part; 30—Second outer edge;
301—Second abutting part; 301*a*—Second slot;
31—Second clamping surface; 32—Bending area;
5—Spring; X—First direction.
6—Baseball cap; 61—Cap button.

DETAILED DESCRIPTION

The present disclosure will be described in detail below with reference to the drawings and in combination with embodiments. The examples are provided by way of explanation of the present disclosure and are not intended to limit the present disclosure. In fact, it will be apparent to those skilled in the art that modifications and variations may be made to the present disclosure without departing from the scope or spirit of the present disclosure. For example, features shown or described as part of one embodiment may be used in another embodiment to yield yet another embodiment. Therefore, it is intended that the present disclosure cover such modifications and variations that fall within the scope of the appended claims and their equivalents.

In the description of the present disclosure, the terms "longitudinal", "transverse", "upper", "lower", "front", "rear", "left", "right", "vertical", "horizontal", "top", "bottom", etc. indicate orientation or positional relationships based on the orientation or positional relationships shown in the drawings. They are only for the convenience of describing the present disclosure and do not require that the present disclosure must be constructed and operated in a specific orientation, and therefore cannot be understood as a limitation of the present disclosure. The terms "connected", "linked", "arranged" used in the present disclosure should be understood broadly. For example, it may be a fixed connection or a detachable connection; it may be directly connected or indirectly connected through an intermediate component; it may be a wired electrical connection, a wireless electrical connection, or a wireless communication signal connection. Those skilled in the art can understand the specific meanings of the above terms according to the specific circumstances.

One or more examples of the present disclosure are shown in the accompanying drawings. The detailed description uses numerical and alphabetic references to refer to features in the drawings. Similar or similar labels in the drawings and description have been used to refer to similar or similar parts of the present disclosure. As used herein, terms such as "first", "second" and "third" are used interchangeably to distinguish one component from another and are not intended to indicate the position or importance of individual components.

As shown in FIG. 1 to FIG. 5, according to some embodiments provided by the present disclosure, a wall-mounted hat rack for displaying or storing a baseball cap 6 is disclosed, including a hat rack main body 1 and a clamping assembly. The hat rack main body 1 has a first surface 101 extending along a preset direction X, where the first surface 101 provides a base for the hat rack to carry and display the baseball cap 6. The clamping assembly may be one or more, arranged at intervals on the hat rack main body 1 along the extension direction of the first surface 101.

The clamping assembly includes a first clamping part 2 and a second clamping part 3. The first clamping part 2 and the second clamping part 3 are arranged along the extension direction of the first surface 101 of the hat rack main body 1. The first clamping part 2 and the second clamping part 3 can undergo elastic deformation and have a restoring force. This design allows at least a part of the baseball cap 6 to be selectively inserted between the first clamping part 2 and the second clamping part 3, and to be clamped and fixed by the relative clamping force between the first clamping part 2 and the second clamping part 3. The baseball cap 6 is in close contact with the first clamping surface 21 and the second clamping surface 31 to achieve stable storage and display of the baseball cap 6.

As shown in FIG. 2A to FIG. 5, the clamping assembly includes an engagement part arranged on the first clamping surface 21 of the first clamping part 2 for engaging a cap button 61 of the baseball cap 6. The engagement part includes a groove 201 and two or more through holes 203, all defined on the first clamping surface 21 of the first clamping part 2, and the through holes 203 penetrate through a bottom of the groove 201. When the first clamping part 2 and the second clamping part 3 cooperate to clamp the baseball cap 6, the cap button 61 is first embedded in the groove 201 and passes through a corresponding through hole 203, thereby achieving dual limitation of the cap button 61 in the horizontal and vertical directions to ensure that the baseball cap 6 is firmly fixed at a preset position. In addition, the groove 201 and the through holes 203 are not only configured to guide and accommodate the cap button 61, but more importantly, after the cap button 61 is embedded in the groove 201, the inner edge of the groove 201 limits or clamps the cap button 61 to achieve fixation, and the first clamping surface 21 can more closely fit the contour of the cap body. Since the cap button 61 is usually slightly higher than the cap surface, if there is no groove 201 or through hole 203 provided, the clamping surface 21 will only contact a local part of the cap, resulting in unstable clamping or indentation; and through the "recessed" accommodation of the cap button 61 by the groove 201, the entire clamping surface 21 can fully contact the cap around the cap button 61, thereby significantly improving the stability and aesthetics of clamping, and preventing the cap from sliding or deforming. The synergistic structure of the groove 201 and the through holes 203 not only achieves effective positioning and fixation of the cap button 61, but also significantly improves the overall clamping effect and usability flexibility by optimizing the contact of the clamping surface and enhancing the adaptability to the cap button 61.

Furthermore, the design of providing multiple through holes 203 (for example, two or more) and adopting different shapes (such as circular, oval, or oblong holes) aims to adapt to the cap button 61 structures of different types, sizes, or brands of baseball caps. For example, some cap buttons 61 are circular metal pieces, while others are flat plastic buttons or special-shaped buttons. By providing multiple through hole options, users can choose the most matching through hole for installation according to the actual shape of the cap button 61, thereby ensuring smooth passage and avoiding jamming or damage to the cap button 61 due to mismatched hole positions.

The wall-mounted hat rack further includes an elastic member 5. Both ends of the elastic member 5 are connected to the first abutting part 202 and the second abutting part 301 respectively to provide a relative clamping force. Specifically, when the baseball cap 6 is placed into a clamping space, the first clamping part 2 and/or the second clamping part 3 are forced to open outward, and the elastic member 5 is stretched and stores elastic potential energy; when the external force is removed, the elastic member 5 releases energy through rebound, driving the two clamping parts to return inward, thereby applying a continuous and stable clamping force to the cap body to achieve reliable fixation. In order to achieve peripheral limitation and anti-disengagement of both ends of the elastic member 5, the first abutting part 202 defines a first slot 202*a*, and the second abutting part 301 defines a second slot 301*a*. The both ends of the elastic member 5 are respectively embedded and clamped in the corresponding slots. This structure not only effectively prevents the elastic member 5 from twisting or slipping during long-term use but also ensures the consistency of its force direction, thereby improving the stability and durability of the clamping performance of the elastic member 5.

The clamping assembly further includes a bending part 32. The first clamping part 2 and the second clamping part 3 are connected through the bending part 32 to form an elastically deformable clamping structure. This not only enhances the overall flexibility but also improves the adaptability of clamping, allowing the hat rack to better adapt to baseball caps of different sizes.

The first clamping part 2, the second clamping part 3, and the bending part 32 may be an integrally formed structure, which reduces the number of parts and assembly processes, lowers production costs, and improves the durability and reliability of the product.

The first clamping part 2 and the second clamping part 3 are usually components extending perpendicular to the preset direction X or away from the hat rack main body 1. The first clamping part 2 has a first outer edge 20, and the second clamping part 3 has a second outer edge 30. The length of the second outer edge 30 extending outward is greater than the length of the first outer edge 20 extending outward to form an asymmetric clamping structure, which facilitates the engagement and positioning of the cap button 61. In addition, when the baseball cap 6 is clamped, part of the lower edge of the cap naturally rests on the second clamping part 3 that extends further forward, which provides effective support, preventing the cap from sagging, turning over, or slipping due to gravity, thereby achieving stable display and storage.

Figure 6:
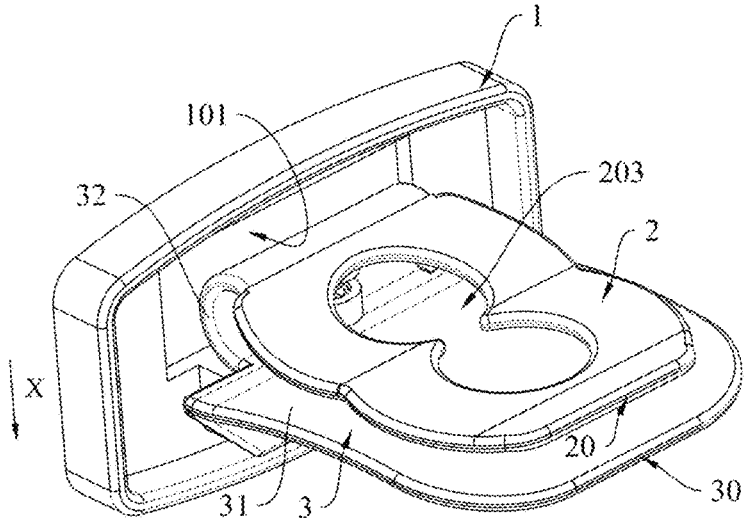
FIG. 6 is a perspective view of a wall-mounted hat clip in Embodiment 2 of the present disclosure.
Figure 7A:
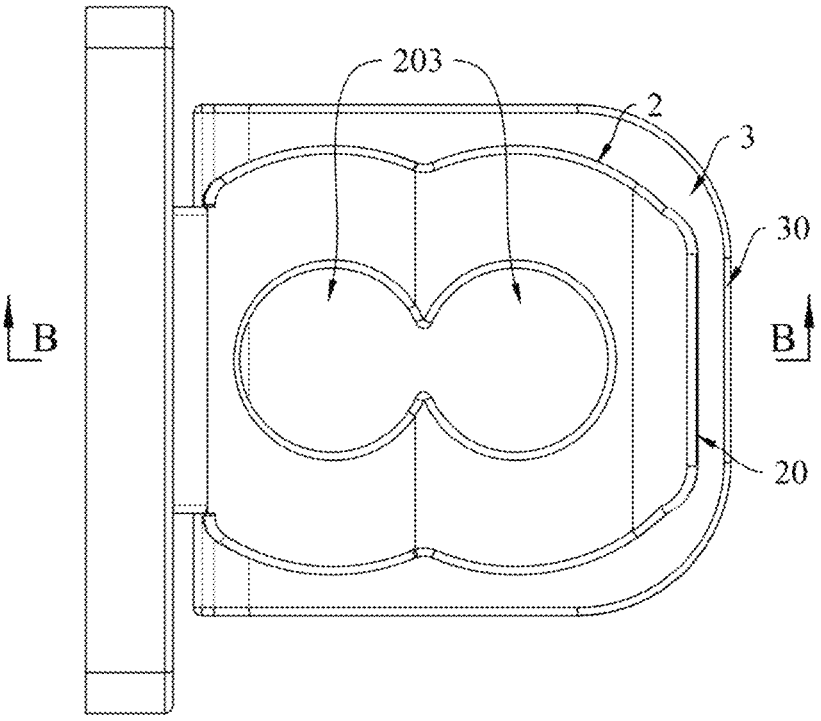
FIG. 7A is a top schematic view of the wall-mounted hat clip in Embodiment 2 of the present disclosure.
Figure 7B:
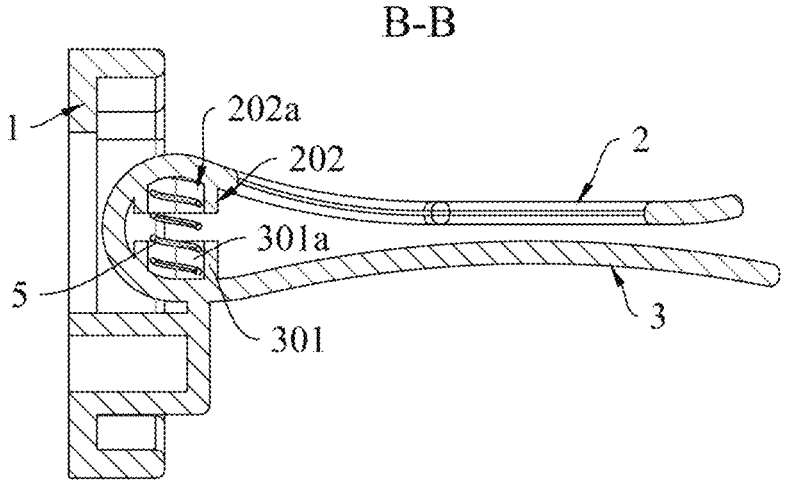
FIG. 7B is a perspective view taken along the B-B direction in FIG. 7A in Embodiment 2 of the present disclosure.
Figure 8:
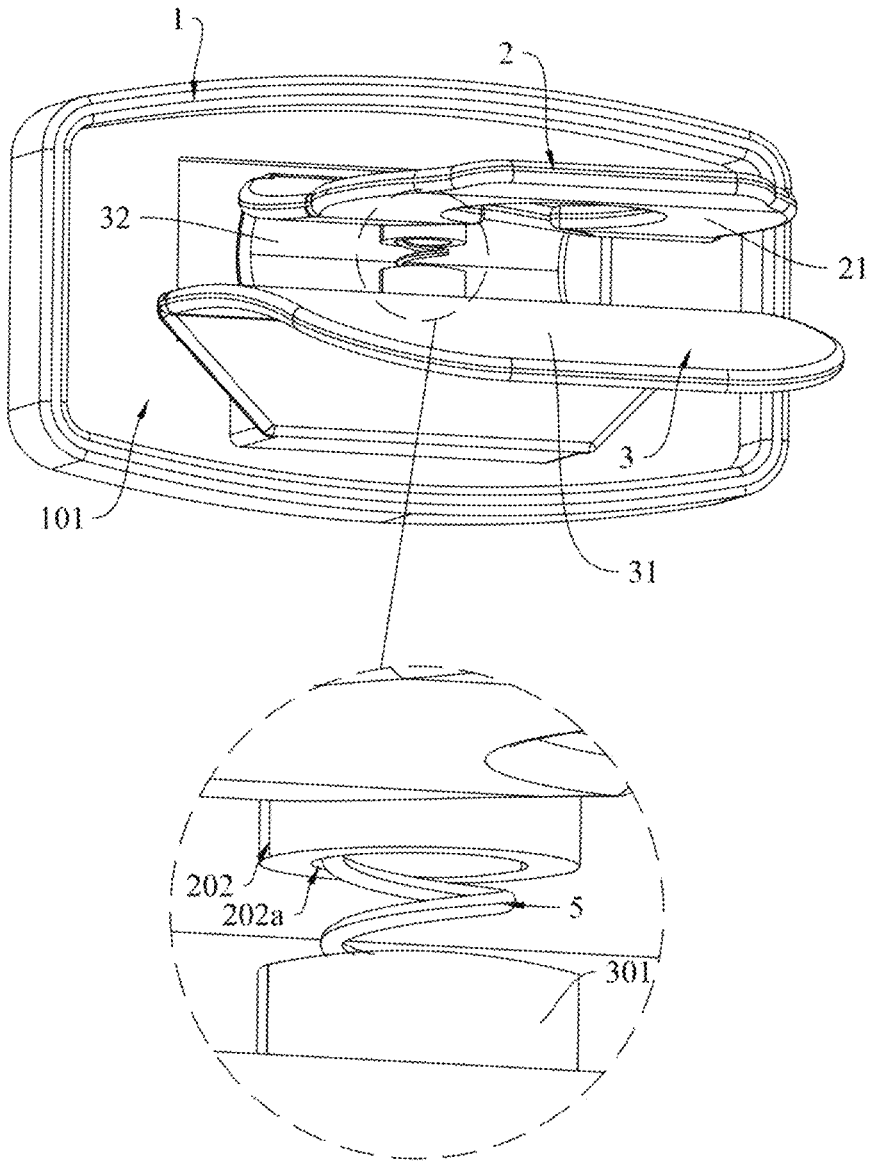
FIG. 8 is a perspective view of a clamping assembly of the wall-mounted hat clip, in an open state, and an enlarged view at position M in Embodiment 2 of the present disclosure.

As shown in FIG. 6 to FIG. 8, according to Embodiment 2 of the present disclosure, a wall-mounted hat rack for displaying or storing a baseball cap 6 is provided, including a hat rack main body 1 and a clamping assembly. The hat rack main body 1 has a first surface 101 extending along a preset direction X. One or more clamping assemblies are arranged along the first surface 101. Each clamping assembly includes a first clamping part 2, a second clamping part 3, and a bending part 32 connected between the first clamping part 2 and the second clamping part 3. The first clamping part 2, the second clamping part 3, and the bending part 32 are integrally formed. The clamping assembly may be integrally formed by stamping metal plate or injection molding of elastic plastic, ensuring the coordination and unity of structural strength and elastic recovery performance.

The first clamping part 2 and the second clamping part 3 are arranged opposite to each other along the extension direction of the first surface 101, forming an elastically openable and closable clamping space. When an external force acts on the second clamping part 3, causing it to bend outward relative to the first clamping part 2, a gap is generated between them, allowing a part of the baseball cap 6 with the cap button 61 to be inserted. After the external force is removed, relying on the elastic restoring force of the material itself, the second clamping part 3 returns to a side of the first clamping part 2, thereby stably clamping and fixing the baseball cap 6 through the relative clamping force between the two.

In some embodiments, a first abutting part 202 is arranged on a side of the first clamping part 2 facing the second clamping part 3, a second abutting part 301 is arranged at a corresponding position of the second clamping part 3, and an elastic member 5 is arranged between the first abutting part 202 and the second abutting part 301. Both ends of the elastic member 5 are connected to the first abutting part 202 and the second abutting part 301 respectively to provide a continuous and stable clamping force, enhancing the adaptability to baseball caps 6 of different thicknesses. To prevent the elastic member 5 from shifting axially during use, a first slot 202*a* is defined on the first abutting part 202, a second slot 301*a* is defined on the second abutting part 301, and the both ends of the elastic member 5 are embedded in the corresponding slots to achieve reliable positioning and limitation.

In some embodiments, the first clamping part 2 has a first outer edge 20, the second clamping part 3 has a second outer edge 30, and the length of the second outer edge 30 extending outward is greater than that of the first outer edge 20, forming an asymmetric clamping structure. This design facilitates the user to quickly guide the cap button 61 into the clamping area when installing the baseball cap, improving operational convenience.

In Embodiment 2, when the baseball cap 6 is clamped, its cap button 61 passes through the through hole 203 and is clamped and limited by the first clamping part 2 and the second clamping part 3, thereby preventing the cap from shifting laterally or accidentally falling off in the clamped state, and achieving effective locking and positioning of the cap button 61. By simplifying the structure and removing the groove, the complexity of the mold and production costs are reduced while ensuring basic clamping and anti-slip functions.

The working principle of the wall-mounted hat rack provided by the present disclosure is based on a dual fixation mechanism combining elastic clamping and mechanical engagement. It achieves stable clamping, anti-slip, and convenient placement and removal of the baseball cap 6 through structural design.

During use, the user aligns the cap button 61 of the baseball cap 6 with the opening between the first clamping part 2 and the second clamping part 3, and applies force to push the cap into the clamping space between the first clamping part 2 and the second clamping part 3. Because the first clamping part 2 and the second clamping part 3 are connected by the bending part 32 to form an elastically deformable integral structure, or rely on the elastic member 5 to provide a restoring force, when an external force acts on the second clamping part 3 or the first clamping part 2 causing them to elastically open relative to each other, a sufficient gap is generated between them to accommodate the cap button 61 of the baseball cap 6. Once the external force is removed, the structure automatically returns to its original position by the elasticity of the material itself or the spring force, causing the first clamping part 2 and the second clamping part 3 to form a stable relative clamping force on the baseball cap 6, thereby achieving basic fixation of the baseball cap 6.

To further prevent the cap from shifting laterally or falling off due to touch, vibration, or gravity during use, the present disclosure is provided with an engagement part. The engagement part includes two through holes 203. When the baseball cap is clamped in place, its cap button 61 at the rear is exactly aligned with and passes through the through holes 203, and the edges of the through holes form a physical limit, preventing the entire baseball cap 6 from moving along the insertion direction.

In Embodiment 1, the through holes 203 are located at the bottom of the groove 201, and the groove 201 provides an accommodation space for the cap button 61 to avoid protrusion interference. In Embodiment 2, although the groove 201 is omitted, the through holes 203 still retain their function to ensure effective locking of the cap button 61.

In addition, the asymmetric outer edge design, i.e., the second outer edge 30 is longer than the first outer edge 20, helps guide the cap button 61 smoothly into the area of the through holes 203, improving installation convenience. Multiple clamping assemblies are arranged longitudinally, allowing multiple caps to be neatly stored and displayed on the same hat rack main body, saving space and being aesthetically orderly.

Analysis shows that the present disclosure discloses a wall-mounted hat rack. By providing the first clamping part and the second clamping part with a relative clamping force, the baseball cap can be clamped securely, preventing slipping or shaking. This clamping method requires no additional tools or complex operations; users only need to push a portion of the baseball cap into place for automatic clamping and fixation, enhancing convenience and safety of use. Furthermore, the engagement part disposed on the clamping surface can engage the cap button of the baseball cap. This structure of the engagement part not only assists in positioning but also physically forms a limitation, preventing the baseball cap from easily slipping out of the clamping assembly under minor external force (such as touch or vibration), significantly improving the reliability of the overall fixation. The clamping assembly itself possesses a certain ability for elastic deformation, achieved through the bending part and/or the elastic member, allowing it to adapt to cap buttons of different thicknesses or hardness.

The above are only some embodiments of the present disclosure and are not intended to limit the present disclosure. For those skilled in the art, the present disclosure may have various modifications and changes. Any modifications, equivalent replacements, improvements, etc., made within the spirit and principles of the present disclosure shall be included within the scope of the present disclosure.

What is claimed is:

1. A wall-mounted hat rack for displaying or storing a baseball cap, the wall-mounted hat rack comprising:

a hat rack main body having a first surface extending along a preset direction; and at least one clamping assembly, each comprising a first clamping part and a second clamping part; wherein the first clamping part and the second clamping part are arranged along an extension direction of the first surface, enabling at least a portion of the baseball cap to be selectively insertable between the first clamping part and the second clamping part and clamped by a relative clamping force between the first clamping part and the second clamping part;

wherein each clamping assembly further comprises an engagement part for limiting a cap button of the baseball cap;

wherein the engagement part comprises an upper portion and a lower portion;

the upper portion defines at least one through hole; and the lower portion extends downwards from a bottom surface of the upper portion, the lower portion defines a first clamping surface, a sidewall of the lower portion surrounds to define a groove, the groove is in communication with the at least one through hole, and the sidewall of the lower portion is configured to support a top surface of the baseball cap.

2. The wall-mounted hat rack according to claim 1, wherein in a case where the first clamping part and the second clamping part clamp the baseball cap, the cap button of the baseball cap passes through a corresponding through hole, thereby fixing a clamped position of the baseball cap.

3. The wall-mounted hat rack according to claim 1, wherein the at least one through hole extends through a bottom of the groove.

4. The wall-mounted hat rack according to claim 1, wherein a first abutting part is disposed on a side of the first clamping part facing the second clamping part;

a second abutting part is correspondingly disposed on a side of the second clamping part facing the first clamping part;

each clamping assembly further comprises an elastic member, both ends of the elastic member are connected to the first abutting part and the second abutting part respectively, to provide the relative clamping force.

5. The wall-mounted hat rack according to claim 4, wherein the first abutting part defines a first slot;

the second abutting part defines a second slot, and the both ends of the elastic member extend into the first slot and the second slot respectively to achieve peripheral limitation of the both ends of the elastic member.

6. The wall-mounted hat rack according to claim 1, wherein each clamping assembly further comprises a bending part; the first clamping part and the second clamping part are connected by the bending part to form an elastically deformable clamping structure.

7. The wall-mounted hat rack according to claim 6, wherein the first clamping part, the second clamping part, and the bending part are an integrally formed structure.

8. The wall-mounted hat rack according to claim 1, wherein the first clamping part defines a first outer edge, and the second clamping part defines a second outer edge;

a length of the second outer edge extending outward is greater than a length of the first outer edge extending outward, to form an asymmetric clamping structure.

9. The wall-mounted hat rack according to claim 1, wherein the at least one clamping assembly is a plurality of clamping assemblies that are arranged at intervals along the extension direction of the first surface.

10. The wall-mounted hat rack according to claim 1, wherein the lower portion further comprises two bottom walls, and the two bottom walls extend transversely from a bottom edge of the sidewall.

11. The wall-mounted hat rack according to claim 10, wherein the lower portion further comprises two flaps, and each of the two flaps extend transversely from a side edge of a respective one of the two bottom walls.

12. The wall-mounted hat rack according to claim 1, wherein the at least one through hole comprises a first through hole and a second through hole in communication with each other.

13. The wall-mounted hat rack according to claim 1, wherein in a case where the first clamping part and the second clamping part clamp are in a natural state, the first clamping part does not touch the second clamping part.

* * * * *